United States Patent [19]

Iio et al.

[11] Patent Number: 4,934,912

[45] Date of Patent: Jun. 19, 1990

[54] SLIDING-VANE ROTARY COMPRESSOR WITH VIBRATION CUSHIONING MEMBERS

[75] Inventors: Masahiro Iio; Yoshio Suzuki; Toshihiro Murayama; Mitsuya Ono, all of Konan, Japan

[73] Assignee: Diesel Kiki Co., Ltd., Tokyo, Japan

[21] Appl. No.: 303,661

[22] Filed: Jan. 30, 1989

[30] Foreign Application Priority Data

Feb. 10, 1988 [JP] Japan ..... 63-29941

[51] Int. Cl.[5] ..... F04C 27/00; F04C 29/06

[52] U.S. Cl. ..... 418/149; 418/153; 418/181

[58] Field of Search ..... 418/153, 156, 133, 181, 418/149

[56] References Cited

U.S. PATENT DOCUMENTS 3,096,720 7/1963 Younger ..... 418/133

3,936,238 2/1976 Wycliffe ..... 418/181

4,042,062 8/1977 Tooley ..... 418/181

FOREIGN PATENT DOCUMENTS 131890 6/1988 Japan ..... 418/133

*Primary Examiner*—John J. Vrablik

*Assistant Examiner*—David L. Cavanaugh

*Attorney, Agent, or Firm*—Wenderoth, Lind & Ponack

[57] ABSTRACT

A sliding-vane compressor of the type including a compressor body housed in a front head and a shell, wherein a cushioning member is disposed on at least one of a contacting surface between the front head and the compressor body and a contact surface between the compressor body and the shell for taking up vibration produced by the compressor body before the vibration is transmitted to the shell. The cushioning member which is disposed between a rear side block of the compressor and the shell may be formed integrally with a seal member.

5 Claims, 3 Drawing Sheets

SLIDING-VANE ROTARY COMPRESSOR WITH VIBRATION CUSHIONING MEMBERS

BACKGROUND OF THE INVENTION

1. Field of the Invention

The present invention relates to a sliding-vane rotary compressor.

2. Description of the Prior Art

A sliding-vane rotary compressors, as disclosed for example in Japanese Patent Laid open Publication No. 61-145385, includes a compressor body in which a refrigeration medium is compressed. The compressor body comprises a cylinder having an elliptical bore, a rotor rotatably disposed in the elliptical bore and carrying thereon a plurality of radially movable sliding vanes held in contact with a guide surface defining the elliptical bore. The compresssor body further includes front and rear side blocks disposed on opposite ends of the cylinder to close the bore. The compressor body is assembled with a front head and a housing or shell by a plurality of stud bolts threaded successively through the front head, the front side block, the cylinder, and the rear side block into the shell, with the front head and the shell held in contact with the front side block and the rear side block, respectively. Thus, the compressor body, the front head and the shell are secured together by the stud bolts.

The rotor of the compressor body receives a driving force or torque from a drive shaft which extends through a pair of aligned holes in the front and rear side blocks and are rotatably supported by a pair of bearings received respectively in the aligned holes. The hole in the rear side block is blocked from fluid communication with a high pressure side by a cover connected to the rear side block via an O-ring.

The foregoing connection of the compressor body with the front head and the shell by means of the stud bolts is advantageous in that the vibration of the compressor body per se can be reduced. On the other hand, this connection has a drawback that the vibration of the compressor body is transmitted through the stud bolts and connecting surfaces to the shell, thereby causing the shell to vibrate in resonance with the compressor body which would generate an unpleasant noise.

SUMMARY OF THE INVENTION

With the foregoing difficulties in view, it is accordingly an object of the present invention to provide a sliding-vane rotary compresssor incorporating the structural features which prevent transmission of vibration from a compressor body to a front head and a shell.

Another object of the present invention is to provide a sliding-vane rotary compressor including means for preventing vibration to be transmitted from the compressor to the front head and the shell, which preventing means is combined with seal means for sealing a cover disposed over a rear side block without increasing the total number of components of the compressor.

According to a first aspect of the present invention, there is provided a sliding-vane rotary compressor comprising: a compressor body including a rotor carrying thereon a plurality of radially movable sliding vanes, a cylinder rotatably receiving therein said rotor, and a pair of side blocks disposed on opposite ends of said cylinder; a front head attached to one of said side blocks; a generally cup-shaped shell receiving therein said compressor body and having an open end closed by said front head; and a cushioning member disposed on at least one of a contacting surface between said compressor body and said front head and a contacting surface between said compressor body and said shell.

According to a second aspect of the present invention, there is provided a sliding-vane rotary compressor comprising: a compressor body including a rotor carrying thereon a plurality of radially movable sliding vanes, a cylinder rotatably receiving therein said rotor, and a pair of side blocks disposed on opposite ends of said cylinder; a front head attached to one of said side blocks; a generally cup-shaped shell receiving therein said compressor body and having an open end closed by said front head; a cushioning member disposed at least on a contacting surface between said compressor body and said shell; and a seal member disposed between the other of said side blocks and a cover closing a drive-shaft receiving hole defined in said other side block, said seal member being integral with said cushioning member.

With the cushioning member disposed on the contacting surface between the front head and the compressor body or between the compressor body and the shell, the vibration of the compressor body is not transmitted to the front head and the shell, thus preventing generation of an unpleasant noise.

The cushioning member thus provided does not incur an increase in number of structural components of the compressor due to its integral formation with the seal member which is disposed between the other side block and a cover closing a drive shaft receiving hole defined in the other side block.

Many other advantages and features of the present invention will become manifest to those versed in the art upon making reference to the detailed description and the accompanying sheets of drawings in which preferred structural embodiments incorporating the principles of the present invention are shown by way of illustrative example.

BRIEF DESCRIPTION OF THE DRAWINGS

FIG. 4(*b*) is a view similar to FIG. 4(*a*), but showing a portion of a modified cushioning member;

DETAILED DESCRIPTION

Figure 1:
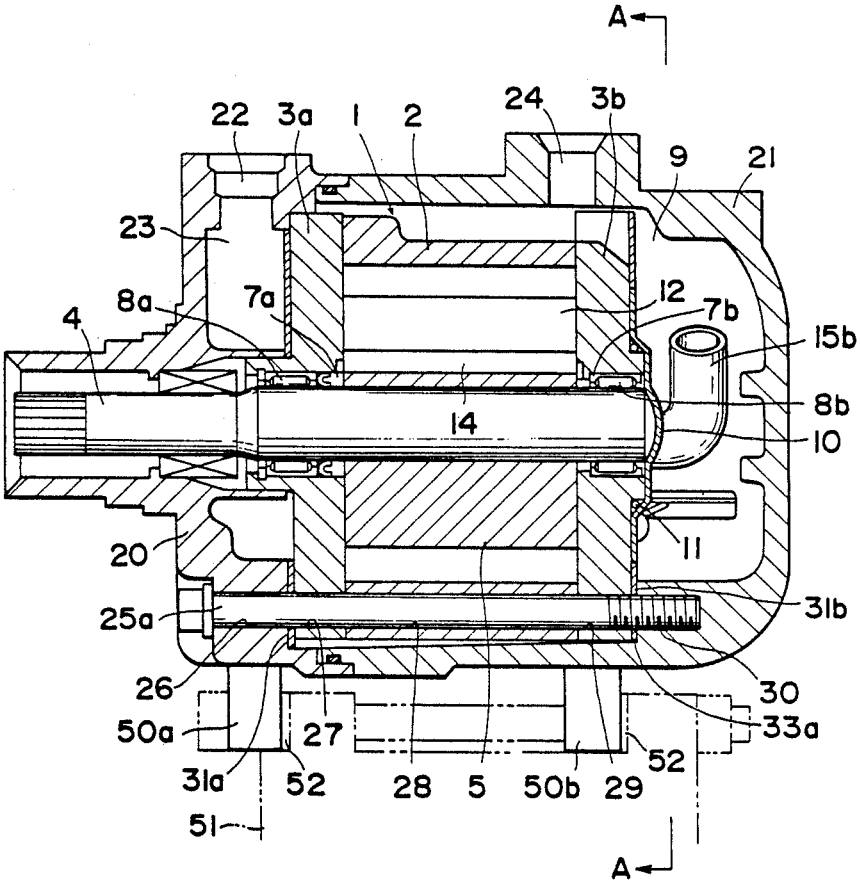
FIG. 1 is a longitudinal cross sectional view of a sliding-vane rotary compressor according to the present invention.
Figure 2:
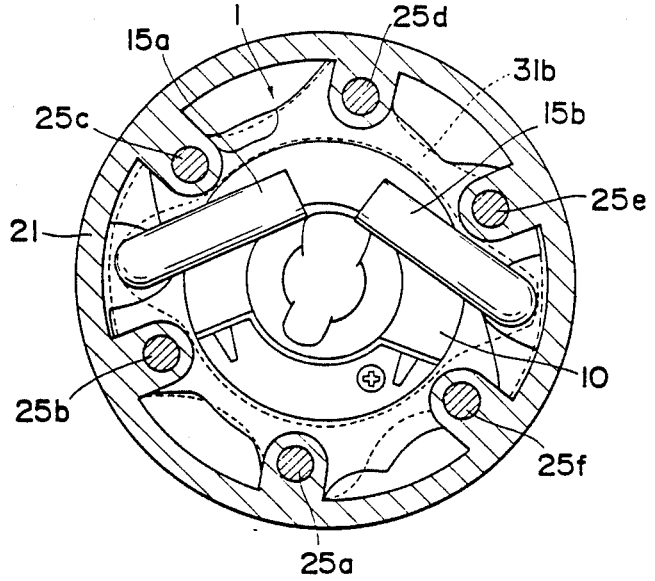
FIG. 2 is a cross-sectional view taken along line A—A of FIG. 1.

FIGS. 1 and 2 show a sliding-vane rotary compressor according to a first embodiment of the present invention. The compressor comprises a compressor body 1 including a cylinder 2 having a substantially elliptical bore defined by an inner peripheral surface of the cylinder 2, and front and rear side blocks 3*a*, 3*b* secured to opposite ends of the cylinder 2. The compressor body 1 further includes a cylindrical rotor 5 concentrically and firmly mounted on a drive shaft 4 and rotatably received in the elliptical bore in the cylinder 2, with diametrically opposite portions of the rotor 5 disposed close to the inner peripheral surface of the cylinder 2.

The drive shaft 4 is rotatably supported on a pair of bearings 8*a*, 8*b* fitted respectively in a pair of drive-shaft receiving holes 7*a*, 7*b* defined respectively in the front side block 3*a* and the rear side block 3*b*. The drive shaft 4 is connected at its one end to an electromagnetic clutch (not shown) for connecting the drive shaft 4 with a driving source. The other end of the drive shaft 4 is received within the hole 7*b* in the rear side block 3*b*. The hole 7*b* is blocked from fluid communication with a high-pressure chamber 9 by means of a cover 10 which is secured to the rear side block 3*b* with an O-ring 11 interposed between the cover 10 and the rear side block 3*b*.

The rotor 5 has a plurality of substantially radially extending grooves 12 slidably receiving therein a corresponding number of vanes (not shown). While the compressor is operating, the vanes are forced radially outwardly into contact with the inner peripheral surface of the cylinder 2 under a back pressure produced in a back pressure chamber 14 defined below the respective grooves 12 and also under a centrifugal force produced by the rotation of the rotor 5. The thus radially outwardly urged vanes slide along the inner peripheral surface of the cylinder 2.

The compressor body 1 has a pair of discharge pipes 15*a*, 15*b* firmly connected to a case secured to outlet ends of a pair of discharge holes (not shown) for guiding a refrigeration medium into the high-pressure chamber 9 defined at the rear side of the compressor. Within the high-pressure chamber 9, an oil is separated from the refrigeration medium as the refrigeration medium is forced from the discharge pipes 15*a*, 15*b* against the inner surface of the rear side of the compressor.

The compressor body 1 is connected to a front head 20 and a shell 21 by a plurality of stud bolts 25*a*–25*f* in such a manner that the compressor body 1 is encased in the front head 20 and the shell 21 with the front and rear side blocks 3*a*, 3*b* held in contact with the front head 20 and the shell 21, respectively.

The front head 20 has an inlet hole 22 communicating with a low-pressure chamber 23 defined in the front head 20 while the shell 21 has an outlet hole 24 communicating with the high-pressure chamber 9 defined between the compressor body 1 and the shell 21.

The number of the stud bolts 25*a*–25*f* is six in the illustrated embodiment. The front head 20 has six holes 26 spaced at equal angular intervals. Likewise, the front side block 3*a*, the cylinder 2 and the rear side block 3*b* have respective holes 27, 28, 29 extending in alignment with the holes 26 in the front head 20. The shell 21 has six threaded holes 30 extending in alignment with the holes 26–29.

The stud bolts 25*a*–25*f* are threaded successively through the holes 26, 27, 28 and 29 into the threaded hole 30 in the shell 21 to thereby assemble the compressor.

In this instance, two identical, generally annular disc-shaped cushioning members 31*a*, 31*b* are disposed respectively between the front head 20 and the front side block 3*a* and between the rear side block 3*b* and the shell 21.

Figure 3:
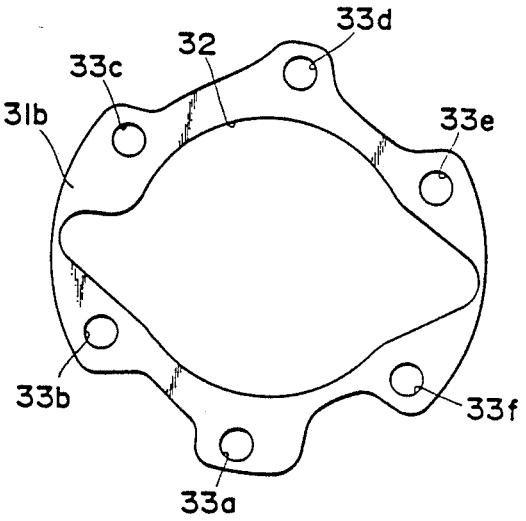
FIG. 3 is a front elevational view of a cushioning member of the compressor.
Figure 4A:
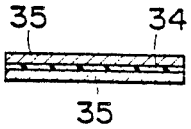
FIG. 4(*a*) is a cross-sectional view of a portion of the cushioning member.
Figure 4B:
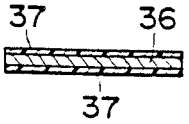

One of the cushioning members 31*b* which is disposed at the rear side of the compressor is indicated by dotted line in FIG. 2, for clarity. The cushioning member 31*b* in its free state has a shape shown in FIG. 3, which shape is suited for attachment to the rear side block 3*b* and the shell 21. To this end, the cushioning member 31*b* has a large central opening 32 for receiving therein the cover 10 and six small holes 33*a*–33*f* disposed circumferentially around the central opening 32 at equal angular intervals for the passage therethrough of the stud bolts 25*a*–25*f*. The cushioning member 31*b* has a laminated construction including an inner layer 34 of resilient material and a pair of outer layers 35, 35 of metal, such as steel or aluminum overlying on opposite surfaces of the inner resilient layer 34, as shown in FIG. 4(*a*). Alternatively, the cushioning member 31*b* may be composed of an inner layer 36 of metal sandwiched by and between a pair of outer layers 37 of resilient material, as shown in FIG. 4(*b*).

Obviously, the cushioning member 31*a* which is disposed between the front head 20 and the front side block 3*a* has a large central hole and six small holes as in the same manner as the cushioning member 31*b* stated above.

With the cushioning members 31*a*, 31*b* thus provided, the vibration produced by the compressor body 1 is substantially absorbed by the cushioning members 31*a*, 31*b* before being transmitted to the front head 20 and the shell 21 with the result that a substantial reduction of noise can be obtained. It has been experimentally proved that a maximum noise reduction is obtained when the cushioning members 31*a*, 31*b* having a thickness of about 0.1 mm to about 0.4 mm are utilized.

Although, in the embodiment described above, the cushioning members 31*a*, 31*b* are disposed respectively between the front head and the front side block and between the rear side block and the shell, a substantial noise reduction is obtained even when one of the cushioning members 31*a*, 31*b* is omitted.

Figure 5:
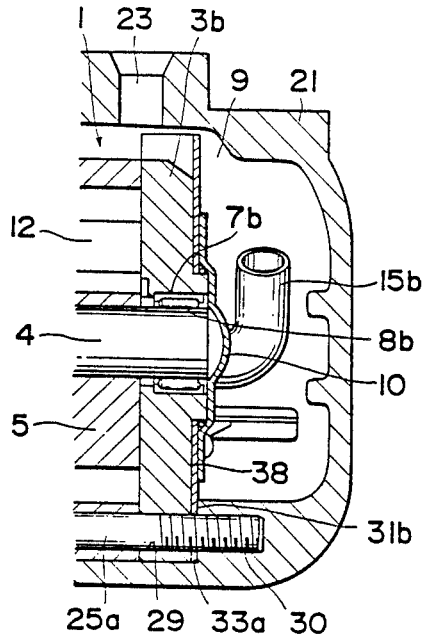
FIG. 5 is a longitudinal cross-sectional view of a rear portion of a sliding-vane rotary compressor according to another embodiment of the present invention.
Figure 6:
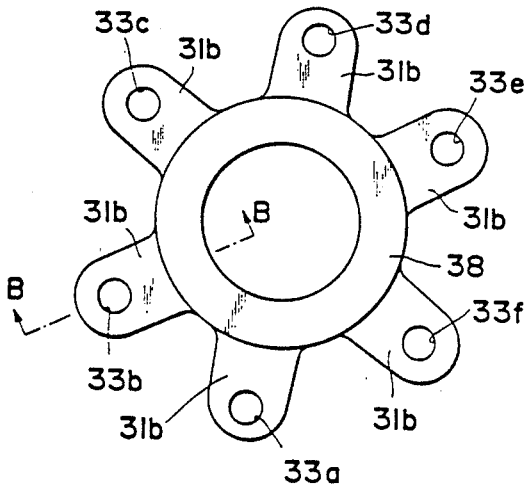
FIG. 6 is a combined cushioning-and-seal member incorporated in the compressor shown in FIG. 5.
Figure 7:
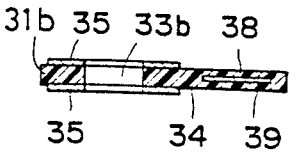
FIG. 7 is a cross-sectional view taken along line B—B of FIG. 6.

FIGS. 5 through 7 show a second embodiment of the present invention, in which a seal member and a cushioning member are formed integrally with each other so as to concurrently provide a cushioning between the rear side block 3*b* of the compressor body 1 and the shell 21 and a seal between the rear side block 3*b* and the cover 10. According to this embodiment, six cushioning members 31*b* are formed integrally with and extend radially outwardly from an annular seal member 38. The cushioning members 31*b* are spaced at equal angular intervals and have respective small holes 33*a*–33*f* for the passage therethrough of stud bolts (only one shown in FIG. 5 at 25*a*). As shown in FIG. 7, each of the cushioning members 31*b* has a laminated structure including an inner layer 34 of resilient material and a pair of outer layers 35 of metal overlying on opposite sides of the inner resilient layer 34. On the other hand, the seal member 38 includes an annular sheet 39 embedded in a resilient body of the seal member 38 which is formed of the same material as the inner resilient layer 34 of each of the cushioning members 31*b*.

According to the second embodiment described above, the cushioning members 31*b* are disposed between the rear side block 3*b* of the compressor body 1 and the shell 21 while the seal member 38 is disposed between the rear side block 3*b* and the cover 10. With this arrangement, the cushioning effect and the sealing effect are obtained at the same time.

With the integral formation of the cushioning members 31*b* and the seal member 38, the total number of components of the compressor does not increase. This integral formation of the second embodiment is advantageous over the first embodiment because the seal member 38 of the second embodiment corresponds to a central portion which is removed as a result of formation of the central opening 32 when the cushioning member 31*b* of the first embodiment is produced. Accordingly, the amount of material used is reduced.

As shown in FIG. 1, the compressor is mounted on a bracket 51 via a pair of cushioning members 52 disposed respectively between the bracket 51 and one of a pair of legs 50*a*, 50*b* extending from the front head 20 and between the bracket 51 and the other leg 50*b* extending from the shell 22. With the cushioning members 52 thus provided, the transmission of vibration from the compressor or an engine to the bracket 51 and, consequently, the generation of an unpleasant noise are prevented.

Obviously, various modifications and variations of the present invention are possible in the light of the above teaching. It is therefore to be understood that within the scope of the appended claims the invention may be practiced otherwise than as specifically described.

What is claimed is:

1. A sliding-vane rotary compressor comprising:

(a) a compressor body including a rotor carrying thereon a plurality of radially movable sliding vanes, a cylinder rotatably receiving therein said rotor, and a pair of side blocks disposed on opposite ends to one of said cylinder;

(b) a front head attached to one of said side blocks;

(c) a generally cup-shaped shell receiving therein said compressor body and having an open end closed by said front head; and (d) a cushioning member disposed on at least one of a contacting surface between said compressor body and said front head and a contacting surface between said compressor body and said shell, said cushioning member including an inner layer of resilient material and a pair of outer layers of metal overlying opposite surfaces of said inner resilient layer.

2. A sliding-vane rotary compressor comprising:

(a) a compressor body including a rotor carrying thereon a plurality of radially movable sliding vanes, a cylinder rotatably receiving therein said rotor, and a pair of side blocks disposed on opposite ends of said cylinder;

(b) a front head attached to one of said side blocks;

(c) a generally cup-shaped shell receiving therein said compressor body and having an open end closed by said front head;

(d) a cushioning member disposed at least on a contacting surface between said compressor body and said shell; and (e) a seal member disposed between the other of said side blocks and a cover closing a drive-shaft receiving hole defined in said other side block, said seal member being integral with said cushioning member.

3. A sliding-vane rotary compressor according to claim 2, said seal member being formed of a resilient material and including a sheet of metal embedded in said resilient material.

4. A sliding-vane rotary compressor according to claim 2, said cushioning member including an inner layer formed of a resilient material and a pair of outer layers of metal overlying opposite surfaces of said inner resilient layer.

5. A sliding-vane rotary compressor comprising:

(a) a compressor body including a rotor carrying thereon a plurality of radially movable sliding vanes, a cylinder rotatably receiving therein said rotor, and a pair of side blocks disposed on opposite ends to one of said cylinder;

(b) a front head attached to one of said side blocks;

(c) a generally cup-shaped shell receiving therein said compressor body and having an open end closed by said front head; and (d) a cushioning member disposed on at least one of a contacting surface between said compressor body and said front head and a contacting surface between said compressor body and said shell, said cushioning member including an inner layer of metal and a pair of outer layers of resilient material overlying opposite surfaces of said inner metallic layer.

* * * * *